US008188030B2

(12) United States Patent
Rieth et al.

(10) Patent No.: US 8,188,030 B2
(45) Date of Patent: May 29, 2012

(54) FABRIC SOFTENER COMPOSITIONS AND METHODS OF MANUFACTURE THEREOF

(75) Inventors: Lee Richard Rieth, Plymouth, MN (US); Dorie J. Yontz, Bloomington, MN (US); Daniel Warren Gilbert, Richfield, MN (US)

(73) Assignee: Segetis, Inc., Golden Valley, MN (US)

( * ) Notice: Subject to any disclaimer, the term of this patent is extended or adjusted under 35 U.S.C. 154(b) by 0 days.

(21) Appl. No.: 13/231,459

(22) Filed: Sep. 13, 2011

(65) Prior Publication Data

US 2012/0065113 A1 Mar. 15, 2012

Related U.S. Application Data

(60) Provisional application No. 61/382,318, filed on Sep. 13, 2010.

(51) Int. Cl.
*C11D 3/50* (2006.01)

(52) U.S. Cl. ..... 510/505; 549/347; 549/369

(58) Field of Classification Search ..... 510/505; 549/347, 369

See application file for complete search history.

(56) References Cited

U.S. PATENT DOCUMENTS

| | | | | |
|---|---|---|---|---|
| 1,934,309 | A | 11/1933 | Hoover | |
| 2,008,720 | A | 7/1935 | Lawson | |
| 2,260,261 | A | 10/1941 | Morey et al. | |
| 2,556,135 | A | 6/1951 | Croxall et al. | |
| 2,654,723 | A | 10/1953 | Greene | |
| 2,985,536 | A | 5/1961 | Stein et al. | |
| 3,201,420 | A | 8/1965 | Fuzesi et al. | |
| 3,658,789 | A | 4/1972 | Fried | |
| 3,855,248 | A | 12/1974 | Lannert et al. | |
| 4,460,767 | A | 7/1984 | Matsumura et al. | |
| 4,792,411 | A | 12/1988 | Walsh | |
| 4,806,448 | A | 2/1989 | Roth | |
| 5,266,592 | A | 11/1993 | Grub et al. | |
| 5,545,350 | A | 8/1996 | Baker et al. | |
| 5,705,087 | A | 1/1998 | Mushrush et al. | |
| 6,156,710 | A * | 12/2000 | Sivik et al. | 510/101 |
| 6,239,087 | B1 * | 5/2001 | Mao et al. | 510/101 |
| 2003/0167681 | A1 | 9/2003 | Delgado Puche | |
| 2004/0024260 | A1 | 2/2004 | Winkler et al. | |
| 2004/0167245 | A1 | 8/2004 | Chappelow et al. | |
| 2006/0069230 | A1 | 3/2006 | Papisov | |
| 2008/0242721 | A1 | 10/2008 | Selifonov | |

FOREIGN PATENT DOCUMENTS

| | | | |
|---|---|---|---|
| CA | 1000285 | | 11/1976 |
| DE | 3220035 | A1 | 1/1983 |
| DE | 10036423 | A1 | 3/2001 |
| EP | 012543 | A1 | 6/1980 |
| EP | 0308956 | A2 | 3/1989 |
| EP | 0507190 | A1 | 10/1992 |
| FR | 1445013 | | 7/1966 |
| JP | 284327 | | 9/1953 |
| JP | 4217972 | | 8/1992 |
| JP | 2006143702 | A | 6/2006 |
| SU | 722912 | | 3/1980 |
| WO | 9412489 | A1 | 6/1994 |
| WO | 2004099173 | A1 | 11/2004 |
| WO | 2005095378 | A2 | 10/2005 |
| WO | 2005097723 | A2 | 10/2005 |
| WO | 2005097724 | A1 | 10/2005 |
| WO | 2008089463 | A2 | 7/2008 |
| WO | 2008098375 | A1 | 8/2008 |

OTHER PUBLICATIONS

Boehm, R., "Knowledge on cyclic ketals. Part 11: Synthesis of some new derivatives and separation of their isomers," Pharmazie 36(5): 329-330 (1981).

Brigl, et al., "The Reaction of the Pyruvic Acid with Glycerin," Annalen der Chemie 476: 215-232 (Received Oct. 7, 1929)(In German Only).

Calinaud, et al., "Cyclic acetal series. XIII. Opening of 4-oxo and 4-hydroxy-3,6,8-trioxabicyclo[3.2.1]octane and 3-pxp-2,5,7-trioxabicyclo[2.2.2]octane rings by lithium aluminum hydride and methylmagnesium iodide," Carbohydrate Research 30(1) 35-43 (1973).

Carey, et al., "Advanced Organic Chemistry, Second Edition, Part B: Reactions and Synthesis," Plenum Press 539-552 (1983).

Gelas, et al., "Synthese du 4-oxo et de 4-hydroxy-3,6,8-trioxabicyclo[3.2.1]octanes," Carbohydrate Research 30(1): 21-34 (1973) (with English abstract).

Grosu, et al., "Stereochemistry and NMR Spectra of Some New Unsymmetrical Substituted 2,2-Dialky1-1,3-Dioxanes," Revue Roumaine de Chimie 41(3-4): 259-263 (1996).

Gutsche, et al., "Reactions of Ethyl Diazoacetate with Aromatic Compounds Containing Hetero Atoms Attached to the Benzyl Carbon," J. Am. Chem. Soc. 76: 2236-2240 (1954).

Hegde, et al., "The Kinetics and Thermodynamics of Bicyclic Ketal Formation: An Application to the Synthesis of the Zaragozic Acids," Tetrahedron 53(32): 11179-11190 (1997).

(Continued)

*Primary Examiner* — John Hardee
(74) *Attorney, Agent, or Firm* — Cantor Colburn LLP

(57) ABSTRACT

Disclosed herein is a fabric softener composition comprising a fabric softener active compound that comprises a quarternary ammonium salt and/or an imidazolinium salt, and a ketal adduct of formula (12)

(12)

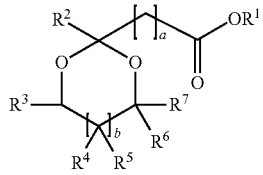

wherein $R^1$ is $C_{1-6}$ alkyl, $R^2$ is hydrogen or $C_{1-3}$ alkyl, each $R^3$ and $R^4$, is independently hydrogen or $C_{1-6}$ alkyl, each $R^5$ and $R^6$ is independently hydrogen or $C_{1-6}$ alkyl, or hydroxymethyl, $R^7$ is hydrogen, $C_{1-6}$ alkyl, $C_{1-6}$ alkyl substituted with up to four $OR^8$ groups wherein $R^8$ is hydrogen, $C_{1-6}$ alkyl, or acetyl, a is 0-3, and b is 0-1.

36 Claims, No Drawings

OTHER PUBLICATIONS

Horsfall, et al., "Fungitoxicity of Dioxanes, Dioxolanes, and Methylenedioxybenzenes," The Connecticut Agricultrual Experiment Station New Haven, Bulletin 673: 1-44, Jun. 1965.
Lukes, Robert M., Preparation of Methyl Esters Containing the 1,3-Dioxane or 2,4,8,10-Tetroxaspiro[5.5]undecane Structure by Ketal Exchange, 26: 2515-2518 (1961).
Meltzer, et al., "2,2-Disubstituted 1,3-Dioxolanes and 2,2-Disubstituted 1,3-Dioxanes," JOC 25: 712-715 (1960).
Meskens, Frans A.J., "Methods for the Preparation of Acetals from Alcohols or Oxiranes and Carbonyl Compounds," Synthesis 501-522 (1981).
Nakamura, et al., "Study on Ketalization Reaction of Poly (vinyl alcohol) by Ketones. IX. Kinetic Study on Acetalization and Ketalization Reaction of 1,3-Butanediol as a Model Compound for Poly (vinyl alcohol)," Polymer Science Part B: Polymer Physics 35(9): 1719-1731 (2000).
Newman, et al.,"Kinetic and Equilibrium Studies of Cyclic Ketal Formation and Hydrolysis," The Journal of the American Oil Chemist's Society 80: 6350-6355 (1958).
Olson, Edwin S., "Subtask 4.1—Conversion of Lignocellulosic Material to Chemicals and Fuels," Final Report for U.S. Dept. of Energy, National Energy Technology Laboratory, Cooperative Agreement No. DE-FC26-98FT40320 (Jun. 2001).
Ono, et al., "Synthesis and Properties of Soap Types of Cleavable Surfactants Bearing a 1,3-Dioxolane Ring Derived from Long-chain Epoxides and Ethyl Levulinate," J. Jpn. Oil Chem. Soc. 42(12): 965-971 (1993).
Wedmid, et al., "Long-Chain Stereomeric 2-Alkyl-4-methoxycarbonyl-1,3-dioxolanes in Glycerol Acetal Synthesis," J. Org. Chem. 42(22): 3624-3626 (1977).
Yamaguchi, Masahiko, "Synthesis of Polycyclic Aromatic Compounds via Polyketides," Yuki Gosei Kagaku Kyokaishi 45(10) 969-982 (1987) (Chinese—Translation of Abstract Only).
Zhang, et al., "Synthesis of Ketals of 4-Oxopentanoates," Lanzhou Daxue Xuebao, Ziran Kexueban 30(2): 66-70 (1994).
Arquad 2HT-75 Rinse Cycle Fabric Softner Formulation Guide; Akzo Nobel Surface Chemistry LLC; 3 pages; 2009.
Mishra, et al., "Ester Quats: The Novel Class of Cationic Fabric Softners," Journal of Oleo Science; 56(6): pp. 269-276 (2007).
Tetranyl L6/90 Cationic Surfactant for Domestic Fabric Softners; Kao Corporation, Member of Kao Chemicals Europe; Technical Data Sheet; S.A.; 2 pages; 2004.

* cited by examiner

FABRIC SOFTENER COMPOSITIONS AND METHODS OF MANUFACTURE THEREOF

CROSS-REFERENCE TO RELATED APPLICATIONS

This application claims priority to U.S. provisional application 61/382,318 filed on Sep. 13, 2010, the entire contents of which are hereby incorporated by reference.

BACKGROUND

This disclosure is related to fabric softener compositions and to methods of manufacture thereof.

Fabric softeners (also called fabric conditioners) are used to prevent static cling and to make a fabric softer. Fabric softeners are widely used by home consumers and commercial laundries to provide softness, surface smoothness, good draping qualities, fluffiness and antistatic properties while avoiding surface greasiness or excessive build-up on the fabric. Although fabric softener technology is well known, the exact softening mechanism is not fully understood. One commonly accepted mechanism relates softness to the lubricity of the adsorbed softener on the cloth and the consequent reduction of friction between the fabric fibers. Fabric softeners are available as a liquid, as powder, as molded solids (such as bars), or as dryer sheets. They can be applied to fabrics in the washing machine, in the clothes dryer, or as a spray. Popular brand names include DOWNY (LENOR), GAIN, SNUGGLE, BOUNCE, COMFORT AND STA-SOFT.

Fabric softener compositions that can be added to the rinse water when washing household laundry normally contain, as an active substance (also called a fabric softener active), a water-insoluble quaternary ammonium compound. Commercially available fabric softener compositions are based on aqueous dispersions of water-insoluble quaternary compounds. Recently, there has been increasing interest in biodegradable active substances. Such substances include, for example, esters of quaternary ammonium compounds, so-called "esterquats," which have at least one long-chain hydrophobic alkyl or alkenyl group interrupted by carboxyl groups.

Active substances in fabric softener compositions that impart a good soft handle to the treated textile generally have the disadvantage that they may lower the water absorbency and wickability of the textile fabric. This is troublesome in the use of 100% cotton items, such as towels and diapers, where softness and water absorbency properties are both desired. The problem is generally exacerbated in more hydrophobic synthetic fibers, such as polyester, polypropylene and nylon and blends thereof with other synthetic and natural fibers. The problem may be so severe that many garments made from high performance fabrics where the ability to rapidly wick water from the skin and dry quickly actually include warnings against using any fabric softener during the laundering process because the use of the fabric softener may destroy the water-absorbency, rewettability and wickability properties of the fabric—properties key to their performance. The disadvantage of reduced water absorbency is often highly pronounced in the case of certain active substances, such as the fatty acid quats.

SUMMARY

Disclosed herein is a fabric softener composition comprising a fabric softener active compound that comprises a quarternary ammonium salt and/or an imidazolinium salt, and a ketal adduct of formula (12)

(12)

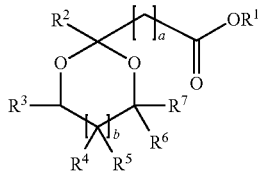

wherein $R^1$ is $C_{1-6}$ alkyl, $R^2$ is hydrogen or $C_{1-3}$ alkyl, each $R^3$ and $R^4$ is independently hydrogen or $C_{1-6}$ alkyl, each $R^5$ and $R^6$ is independently hydrogen or $C_{1-6}$ alkyl, or hydroxymethyl, $R^7$ is hydrogen, $C_{1-6}$ alkyl, $C_{1-6}$ alkyl substituted with up to four $OR^8$ groups wherein $R^8$ is hydrogen, $C_{1-6}$ alkyl, or acetyl, a is 0-3, and b is 0-1.

Disclosed herein too is a method comprising blending a fabric softener active compound and a ketal adduct of formula (12)

(12)

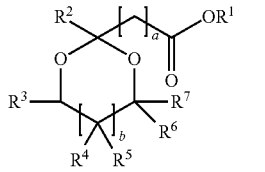

wherein $R^1$ is $C_{1-6}$ alkyl, $R^2$ is hydrogen or $C_{1-3}$ alkyl, each $R^3$ and $R^4$ is independently hydrogen or $C_{1-6}$ alkyl, each $R^5$ and $R^6$ is independently hydrogen or $C_{1-6}$ alkyl, or hydroxymethyl, $R^7$ is hydrogen, $C_{1-6}$ alkyl, $C_{1-6}$ alkyl substituted with up to four $OR^8$ groups wherein $R^8$ is hydrogen, $C_{1-6}$ alkyl, or acetyl, a is 0-3, and b is 0-1; where the fabric softener active compound is a quarternary ammonium salt and/or an imidazolinium salt.

DETAILED DESCRIPTION

Disclosed herein is a fabric softener composition that comprises a fabric softener active compound and a ketal adduct of ketocarboxy esters, in particular levulinate esters. The fabric softener composition offers a broad combination of properties that allows it to be advantageously used in both liquid compositions as well as in solid form. In one embodiment, the fabric softener composition is highly concentrated, stable and can be crystal-clear. In another embodiment, the liquid composition is a low to medium viscosity, easily pourable, product based on the use of one or more quaternary ammonium or imidazolinium salts or the equivalent as active softening component together with a ketal adduct of ketocarboxy esters. The active softening component can be highly concentrated for reduced package size, which takes up less space in storage and is less costly to ship. The highly-concentrated liquid formulations may or may not contain water. The fabric softener composition is particularly advantageous in that it does not necessarily need to contain alcohols or other volatile organic solvents (although these can be optionally added if desired).

The fabric softener may be available in many different forms. For example, it may be available as a solid, a powdered solid, a molded solid, a liquid concentrate, a liquid aqueous concentrates, a liquid non-aqueous concentrate, a dilute composition formed by diluting either a liquid or a solid concentrate, or a composition having the consistency of a lotion. In one embodiment, the fabric softener composition may be embedded on the surface of a fibrous article (e.g., non-woven, woven, spun bond, or the like).

The broad solubilities and solubilization capabilities of the ketal adducts render them useful in a broad variety of fabric softener compositions including aqueous and organic compositions. The ketal adducts are particularly useful in either aqueous composition, organic compositions or in mixed aqueous-organic systems. A further advantage is that certain types of the ketal adducts, such as the levulinate ester ketals, can be derived from biological feedstocks and are therefore obtained from sustainable sources.

The fabric softener composition is expected to maintain a high level of fabric softening combined with desirable fragrance and deposition, and aesthetics. In some cases, freeze/thaw stability can be improved with the use of ketals.

In one embodiment, the fabric softener composition is a low viscosity, pourable liquid composition which comprises about 2 to about 90 weight percent (wt %), of a fabric softener active compound such as quaternary ammonium or imidazolinium salts, and up to about 50 wt % by weight of a ketal adduct with the balance essentially water. In another embodiment, the fabric softener may be a solid, non-aqueous concentrate. All weight percentages are based on the total weight of the fabric softener composition. The fabric softener composition may comprise an effective amount (e.g., up to about 2 wt %) of a fragrance and optionally other additives employed for special effects, which do not negatively impact on the softening action of the active ingredient(s).

A solid fabric softener can be in the form of a solid, in which case it comprises about 50 to about 95 wt % of the fabric softener composition. If the fabric softener is in the form of a liquid concentrate, then it can comprise about 15 to about 50 wt % of the fabric softener composition. If it is in the form of a non concentrated liquid, it can contain about 5 to about 15 wt % of the fabric softener composition, specifically about 7 to about 12 wt % of the fabric softener composition.

In one embodiment, the fabric softener active compound can be a quaternary ammonium salt. The quarternary ammonium salt generally has one or two long alkyl chains and may be biodegradable. In another embodiment, the quarternary ammonium salt is not biodegradable. Examples of suitable fabric softener active compounds are dihydrogenated tallow dimethyl ammonium chloride (DHTDMAC), dicoco dimethyl ammonium chloride, diethyl ester dimethyl ammonium chloride and dimethyl dialkyl ($C_{12}$ to $C_{18}$) ammonium chloride (VARISOFT 432 PPG). In an exemplary embodiment, the fabric softener active compound is biodegradable and comprises a diester quaternary ammonium active compound (DEQA).

Examples of quarternary ammonium salts are $$[(R)_{4-m}—N^{(+)}—[(CH_2)_n—Y—R^1]_m]X^{(-)} \quad (1)$$

wherein each R substituent is hydrogen or a short chain $C_1$-$C_6$, specifically $C_1$-$C_3$ alkyl or hydroxyalkyl group, e.g., methyl, ethyl, propyl, hydroxyethyl, and the like, benzyl, or mixtures thereof; each m is 2 or 3; each n is from 1 to about 4, specifically 2; each Y is —O—(O)C—, —(R)N—(O)C—, —C(O)—N(R)—, or —C(O)—O—, specifically —O—(O)C—; the sum of carbons in each $R^1$, plus one when Y is —O—(O)C— or —(R)N—(O)C—, is $C_6$-$C_{22}$, specifically $C_{12-22}$, more specifically $C_{14}$-$C_{20}$, but no more than one $R^1$ or $YR^1$ sum being less than about 12 and then the other $R^1$ or $YR^1$ sum is at least about 16, with each $R^1$ being a long chain $C_5$-$C_{21}$ (or $C_6$-$C_{22}$), specifically $C_9$-$C_{19}$ (or $C_9$-$C_{20}$), and more specifically $C_{11}$-$C_{17}$ (or $C_{12}$-$C_{18}$), straight, branched, unsaturated or polyunsaturated alkyl.

$R^1$ may be branched alkyl and unsaturated alkyl (including polyunsaturated alkyl), wherein the ratio of branched alkyl to unsaturated alkyl is from about 5:95 to about 95:5, specifically from about 75:25 to about 25:75, more specifically from about 50:50 to about 30:70, especially 35:65.

Optionally, the fabric softener active compound may contain alkyl, monounsaturated alkylene, and polyunsaturated alkylene groups, with the softener active compound containing polyunsaturated alkylene groups being at least about 3%, specifically at least about 5%, more specifically at least about 10%, and even more specifically at least about 15%, by weight of the total softener active present. (As used herein, the "percent of softener active" containing a given $R^1$ group is based upon taking a percentage of the total active based upon the percentage that the given $R^1$ group is, of the total $R^1$ groups present.)

The iodine value of the parent fatty acid of the $R^1$ group is from about 20 to about 140, more specifically from about 50 to about 130; and most specifically from about 70 to about 115; and wherein the counterion, X—, can be any softener-compatible anion, specifically, chloride, bromide, methylsulfate, ethylsulfate, sulfate, and/or nitrate, more specifically chloride.

Alternatively, the fabric softening active compound may have the formula (2):

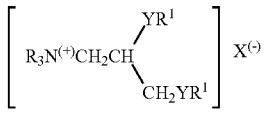

(2)

wherein each Y, R, $R^1$, and X(−) have the same meanings as before. Such compounds include those having the formula: $[CH_3]_3N(+)[CH_2CH(CH_2O(O)CR^1)O(O)CR^1]C_1(-)$ where —O(O)$CR^1$ is derived partly from unsaturated, e.g., oleic, fatty acid and, specifically, each R is a methyl or ethyl group and specifically each $R^1$ is in the range of $C_{15}$ to $C_{19}$ with degrees of branching and substitution being present in the alkyl chains.

Mixtures of active compounds of formula (1) and (2) may also be prepared. The counterion, X(−) above, can be any softener-compatible anion, specifically the anion of a strong acid, for example, chloride, bromide, methylsulfate, ethylsulfate, sulfate, nitrate and the like, more specifically chloride. The anion can also carry a double charge in which case X(−) represents half a group.

The fabric softener active compound can comprise mixtures of compounds containing, respectively, branched and unsaturated compounds. Preferred biodegradable quaternary ammonium fabric softening compounds useful in preparing such mixtures can contain the group —O—(O)$CR^1$, which is derived from unsaturated, and polyunsaturated, fatty acids, e.g., oleic acid, and/or partially hydrogenated fatty acids, derived from vegetable oils and/or partially hydrogenated vegetable oils, such as, canola oil, safflower oil, peanut oil, sunflower oil, corn oil, soybean oil, tall oil, rice bran oil, and the like. Mixtures of unsaturated fatty acids, and mixtures of DEQAs that are derived from different unsaturated fatty acids can be used, and are preferred.

DEQAs prepared with $R^1$ groups that contain branched chains, e.g., from isostearic acid, for at least part of the $R^1$ groups comprise the other part of the mixture. It is also an option that the fabric softener active itself comprise compounds containing mixed branched-chain and unsaturated $R^1$ groups. The total of active represented by the branched chain groups is typically from about 5% to about 95%, specifically from about 25% to about 75%, more specifically from about 35% to about 50%.

Suitable branched chain fatty acids that can be used to prepare branched, or mixed branched alkyl and unsaturated alkyl DEQAs, can be prepared by a variety of methods. The corresponding branched chain fatty alcohols can be prepared by reduction of the branched chain fatty acids by standard reactions, e.g., using borane-tetrahydrofuran (THF) after the method of Brown, J. Amer. Chem. Soc. (1970), 92, 1637, incorporated herein by reference. The following are non-limiting examples of branched chain fatty acids.

Branched chain fatty acid 1: 2-n-heptylundecanoic acid having the formula:

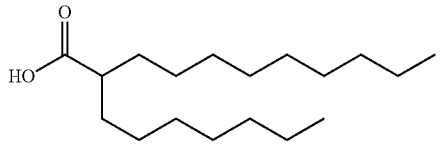

Branched chain fatty acid 2: 2-n-hexyldecanoic acid having the formula:

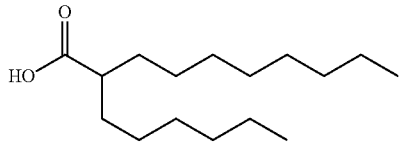

Branched chain fatty acid 3: 2-n-butyloctanoic acid having the formula:

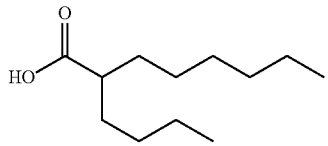

Branched chain fatty acid 4: 5,7,9-trimethylnonanoic acid having the formula:

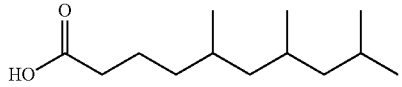

and branched Chain Fatty Acid 5: alpha-alkylated carboxylic acids having the formula:

$RR'CHCO_2H$

Examples of the quarternary ammonium salts that can be used are shown in the formulas (3)-(11) below:

(3)

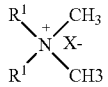

-continued (4)

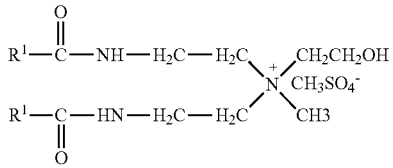

(5)

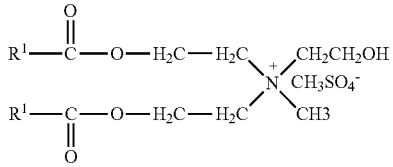

(6)

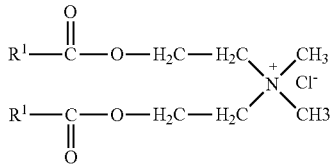

(7)

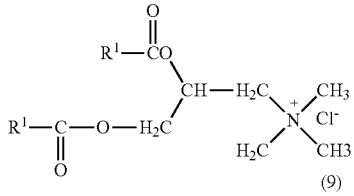

(9)

(8)

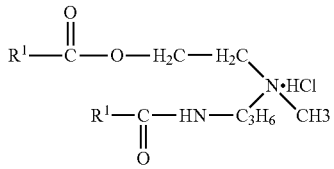

(9)

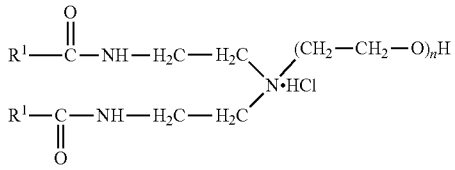

where $R^1$ is defined above.

Imidazolinium salts may also be used as the fabric softener active compound. Examples of suitable imidazolinium salts are methyl-1-tallow amidoethyl-2-tallow imidazolinium methosulfate and methyl-1-oleyl amidoethyl-2-oleyl imidazolinium methosulfate (VARISOFT 3690 PG).

Examples of imidazolinium structures are (10)

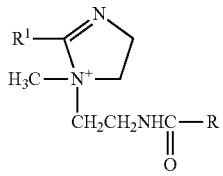

-continued (11)

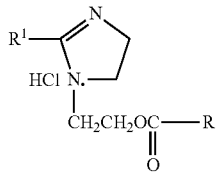

The fabric softener active compound is added in an amount of about 2 wt % to about 90 wt %, based on the total weight of the fabric softening composition. In an exemplary embodiment, the fabric softener active compound is added in an amount of about 5 wt % to about 85 wt %, specifically about 10 to about 80 wt %, and more specifically about 20 to about 75 wt %, based on the total weight of the fabric softening composition.

The ketocarboxy ester ketals, which are sometimes referred to herein as "ketal adducts" have the general formula (12):

(12)

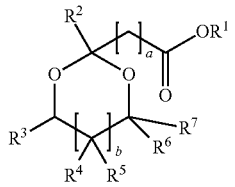

wherein $R^1$ is $C_{1-6}$ alkyl, $R^2$ is hydrogen or $C_{1-3}$ alkyl, each $R^3$ and $R^4$, is independently hydrogen or $C_{1-6}$ alkyl, each $R^5$ and $R^6$ is independently hydrogen or $C_{1-6}$ alkyl, or hydroxymethyl, $R^7$ is hydrogen, $C_{1-6}$ alkyl, $C_{1-6}$ alkyl substituted with up to four $OR^8$ groups wherein $R^8$ is hydrogen, $C_{1-6}$ alkyl, or acetyl, a is 0 to about 3, and b is 0 to about 1.

More specifically, $R^1$ is $C_{1-6}$ alkyl, $R^2$ is methyl, each $R^3$ and $R^4$, is independently hydrogen or $C_{1-6}$ alkyl, each $R^5$ and $R^6$ is independently hydrogen, $C_{1-3}$ alkyl, or hydroxymethyl, $R^7$ is hydrogen, $C_{1-3}$ alkyl, or $C_{1-4}$ alkyl substituted with up to four —$OR^8$ groups wherein $R^8$ is hydrogen or a $C_{1-3}$ alkyl group, a is about 1 to about 3, and b is 0 to about 1.

Even more specifically $R^1$ is $C_{1-4}$ alkyl, $R^2$ is methyl, $R^3$ is hydrogen, $R^6$ is hydrogen, $C_{1-3}$ alkyl, or hydroxymethyl, $R^7$ is hydrogen, $C_{1-3}$ alkyl, or $C_{1-4}$ alkyl substituted with up to four —$OR^8$ groups wherein $R^8$ is hydrogen or a $C_{1-3}$ alkyl group, a is about 2 to about 3, and b is 0.

In a specific embodiment $R^1$ is $C_{1-4}$ alkyl, $R^2$ is methyl, $R^3$ is hydrogen, $R^6$ is hydrogen, methyl, ethyl, or —$CH_2OH$, $R^7$ is methyl, ethyl, —$CH_2OH$, —$CH_2OCH_3$, —$CH_2OCH_2CH_3$, —$CH(OH)CH_2OH$, or —$(CH(OH))_3CH_2OH$, a is 2, and b is 0.

Still more specifically, the ketal adduct of formula (12) is the glycol adduct of a levulinic acid ester having formula (12a), or the 1,2-propanediol adduct of a levulinic acid ester, having formula (12b):

(12a)

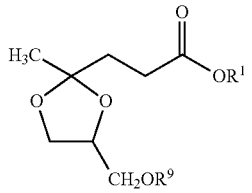

-continued (12b)

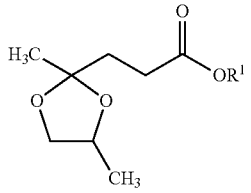

wherein $R^1$ is as defined above, specifically a $C_{1-4}$ alkyl, more specifically ethyl or butyl, and $R^9$ is hydrogen or $C_{1-4}$ alkyl. Ethyl levulinate glycerol ketal ("EtLGK") is obtained when $R^1$ is ethyl and $R^9$ is hydrogen in formula (12a), and ethyl levulinate propylene glycol ketal ("EtLPK") is obtained when $R^1$ is ethyl in formula (12b).

The ketal adducts of formula (12) can be obtained by the acid-catalyzed reaction of the corresponding ketoacid ester of formula (13) with a polyol of formula (14):

(13)

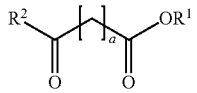

(14)

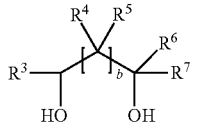

wherein each of $R^1$, $R^2$, $R^3$, $R^4$, $R^6$, and $R^7$, and a and b are as defined above. Reaction conditions are described in WO 09/032,905, for example. Many of the compounds falling within the scope of formulas (13) and (14) can be bio-sourced. The ketal adducts thus provide an entry point for a broad variety of bio-sourced solvents. For example, levulinic acid is produced by the thermochemical treatment of various carbohydrates such as cellulose; subsequent esterification with bio-sourced alkanols and ketalization of the levulinate ester with polyhydroxy compounds such glycerol or propylene glycol produces a bioderived solvent.

In a highly advantageous feature, selection of each of the specific $R^1$, $R^2$, $R^3$, $R^4$, $R^6$, and $R^7$ groups and a and b in the ketal adducts of formula (12) allows the chemical and physical properties of the ketal adducts to be adjusted to achieve the desired combination of properties, for example, solubilizing activity, coupling solvent activity, surface tension reduction, and volatility. The ability to adjust each of these features using a single scaffold provides greater flexibility in designing solvents that achieve the technical requirements of the foregoing compositions.

Thus, in a specific embodiment each of the specific $R^1$, $R^2$, $R^3$, $R^4$, $R^6$, and $R^7$ groups and a and b are selected to provide a desired solubilizing activity, that is, the ability of the ketal adduct to solubilize a solute. The presence of ester, ether-like, and optionally hydroxyl functionality allows interaction of the ketal adduct with a variety of solute functional groups.

In addition to solubilization, the ketal adducts (12), specifically (12a) and (12b) can be effective coupling solvents. Coupling solvents act to solubilize two components that are wholly or partially immiscible in the absence of the coupling solvent, for example, mixtures of oil and water. Effective coupling solvents generally have both lipophilic and hydrophilic character. Appropriate selection of each of the specific $R^1$, $R^2$, $R^3$, $R^4$, $R^6$, and $R^7$ groups and a and b can provide effective coupling agents for a variety of immiscible systems. EtLGK in particular demonstrates coupling ability in aqueous systems.

The ketal adducts (12) specifically (12a) and (12b) can further be used to reduce the surface tension of solvents such as water. The surface tension of water is 72 dynes/cm at 25° C., which means that it would take a force of 72 dynes to break a surface film of water 1 cm long. The surface tension of water is quite high among common liquids and arises from the polar nature of the water molecule. For a liquid to wet the surface of a solid, the surface tension of the liquid must be lower than the solid surface tension. So, while water is generally a preferred carrier because of its low cost and low flammability, its surface tension must be reduced in many applications so it can spread and wet surfaces. Appropriate selection of each of the specific $R^1$, $R^2$, $R^3$, $R^4$, $R^6$, and $R^7$ groups and a and b can provide effective agents to reduce surface tension in a variety of aqueous systems. EtLGK in particular demonstrates the ability to effectively reduce surface tension of aqueous solutions without the environmental and volatile organic compound (VOC) issues affiliated with other solvents.

The ketal adducts (12) specifically (12a) and (12b) are further advantageous due to their low volatility. Volatility manifests itself in a number of key properties for solvents, including boiling point, vapor pressure, relative evaporation rate, flammability, odor, and volatile organic compound content. The desired volatility profile of a solvent varies considerably by application, and there are often conflicting considerations. For instance, highly volatile process solvents require less energy to remove after use, but in many cases also require special handling due to higher flammability. Appropriate selection of each of the specific $R^1$, $R^2$, $R^3$, $R^4$, $R^6$, and $R^7$ groups and a and b can further provide a selected volatility. EtLGK and EtLPK in particular are of acceptably low volatility and low flammability.

As stated above, the ketal adducts (12) specifically (12a) and (12b), more specifically 1(b), are useful in fabric softener compositions. The ketal adducts have excellent combination of properties for use in this applications, including solubilizing activity, coupling activity, low flammability, biodegradation, non-corrosiveness, and low odor.

The ketal adducts can be present in the fabric softener compositions in an amount up to 100% by weight of the total amount of solvent present in the composition. The ketal adduct is generally used in amounts of 2 to about 95 wt %, specifically about 5 to about 75 wt % and more specifically in an amount of about 10 to about 45 wt %, based on the total weight of the fabric softener composition.

The fabric softener composition can further comprise one or more of the following components: a fragrant composition that comprises a fragrant compound, a solvent, an optional coupling agent, an optional radical scavenger, an optional pH buffer, an optional surfactant, an optional UV stabilizer, an optional gel network thickener, an optional polymer, salt, an optional conditioning or lubricating agent, an optional preservative, an optional anti-foaming agent, an optional hard water scavenger, an optional colorant, or any combination thereof.

The fabric softening composition may comprise a fragrant composition. The fragrant composition is used to impart a pleasant odor to the fabric. The fragrant composition comprises at least one fragrant molecule. The fragrant molecule can be a naturally occurring molecule or a synthetic molecule (e.g., a molecule that is synthesized in a laboratory from ingredients that are not naturally occurring). Naturally occurring molecules are those that are derived directly or indirectly from living beings (e.g., animals, plants, fruit, flowers, and the like). Naturally occurring molecules include products of naturally occurring molecules and synthetic molecules.

Naturally occurring fragrant molecules include "essential" oils derived from plants. Essential oils are concentrated, hydrophobic liquids containing volatile aroma compounds from plants. Essential oils are also known as volatile, ethereal oils or aetherolea, or simply as the "oil of" the plant from which they were extracted, such as, for example, oil of clove. An oil is "essential" in the sense that it carries a distinctive scent, or essence, of the plant. Essential oils do not have any specific chemical properties in common, beyond conveying characteristic fragrances. Essential oils such as lavender, peppermint, and eucalyptus, are distilled. Raw plant material, comprising flowers, leaves, wood, bark, roots, seeds, or peel, are put into a distillation apparatus over water. As the water is heated the steam passes through the plant material, vaporizing the volatile compounds. The vapors flow through a coil where they condense back to liquid, which is then collected in the receiving vessel.

Essential oils are derived from berries, allspice, juniper, seeds, almond, anise, celery, cumin, nutmeg oil, bark, cassia, cinnamon, sassafras, wood, camphor, cedar, rosewood, sandalwood, agarwood, rhizome, galangal, ginger, leaves, basil, bay leaf, cinnamon, common sage, eucalyptus, lemon grass, melaleuca, oregano, patchouli, peppermint, pine, rosemary, spearmint, tea tree, thyme, wintergreen, resin, frankincense, myrrh, flowers, cannabis, chamomile, clary sage, clove, scented geranium, hops, hyssop, jasmine, lavender, manuka, marjoram, rose, rosemary, basil, lemon grass, ylang-ylang, peel, bergamot, grapefruit, lemon, lime, orange, tangerine, root, valerian, mango, or the like, or a combination comprising at least one of the foregoing.

In addition to the essential oils, the fragrant composition may contain an aroma compound. Aroma compounds may be naturally occurring or may be synthetically produced. Aroma compounds can be found in food, wine, spices, fabric softeners, fragrance oils, and essential oils. For example, many form biochemically during ripening of fruits and other crops. In wines, most form as byproducts of fermentation.

Examples of aroma compounds are alcohols (e.g., furaneol (strawberry), 1-Hexanol (herbaceous, woody), cis-3-Hexen-1-ol (fresh cut grass), menthol (peppermint), or the like, or a combination comprising at least one of the foregoing alcohols); aldehydes (e.g., acetaldehyde (pungent), hexanal (green, grassy), cis-3-Hexenal (green tomatoes), furfural (burnt oats), or the like, or a combination comprising at least one of the foregoing aldehydes); esters (e.g., fructone (fruity, apple-like), hexyl acetate (apple, floral, fruity), ethyl methylphenylglycidate (strawberry), methyl formate, methyl acetate, methyl butyrate, methyl butanoate, ethyl acetate, ethyl butyrate, ethyl butanoate, isoamyl acetate, pentyl butyrate, pentyl butanoate, pentyl pentanoate, or the like, or a combination comprising at least one of the foregoing esters); ketones (e.g., dihydrojasmone (fruity woody floral), oct-1-en-3-one (blood, metallic, mushroom-like), 2-acetyl-1-pyrroline (fresh bread, jasmine rice), 6-acetyl-2,3,4,5-tetrahydropyridine (fresh bread, tortillas, popcorn), or the like, or a combination comprising at least one of the foregoing ketones); lactones (γ-decalactone (intense peach flavor), γ-nonalactone (coconut odor, popular in suntan lotions), δ-octalactone (creamy note, jasmine lactone powerful fatty fruity peach and apricot) massoia lactone (powerful creamy coconut, wine lactone sweet coconut odor) sotolon (maple syrup, curry, fenugreek), or the like, or a combination comprising at least one of the foregoing lactones); thiols (ethanethiol (commonly called ethyl mercaptan), grapefruit mercaptan (grapefruit), methanethiol (commonly called methyl mercaptan), 2-methyl-2-propanethiol (commonly called tertiary-butyl mercaptan)); linear terpenes (e.g., myrcene (woody, complex), geraniol (rose, flowery) nerol (sweet rose, flowery), citral, lemonal, geranial, neral (lemon, lemon myrtle, lemongrass), citronellal (lemon, lemongrass), citronellol (lemon, lemongrass, rose, pelargonium), linalool (floral, sweet, woody, lavender), nerolidol (woody, fresh bark), or the like, or a combination comprising at least one of the foregoing linear terpenes; cyclic terpenes (e.g., limonene, camphor, terpincol, ionone, thujuon, or the like, or a combination comprising at least one of the foregoing cyclic terpenes); aromatic species (e.g., benzaldehyde, eugenol, cinnamaldehyde, ethyl maltol, vanillin, anisole, anethole, estragole, thymol, or the like or a combination comprising at least one of the foregoing aromatic species); amines (e.g., thiethylamine, trimethylamine, cadaverine, pyridine, indole, skatole, or the like, or a combination comprising at least one of the foregoing amines) or the like, or a combination comprising at least one of the foregoing aroma compounds.

Examples of other fragrant components are geraniol, geranyl acetate, linalool, linalyl acetate, tetrahydrolinalool, citronellol, citronellal acetate, dihydromyrcenol, dihydromyrcenyl acetate, tetrahydromyrcenol, terpineol, terpinyl acetate, nopol, nopyl acetate, 2-phenylethanol, 2-phenylethyl acetate, benzyl alcohol, benzyl acetate, benzyl salicylate, benzyl benzoate, styrallyl acetate, amyl salicylate, dimethylbenzyl carbinol, trichloromethylphenylcarbinyl acetate, p-tert.butylcyclohexyl acetate, isononyl acetate, vetiveryl acetate, vetiverol, alpha-n-amylcinammic aldehyde, alphah-hexylcinammic aldehyde, 2-methyl-3-(p-tert.butylphenyl)-propanol, 2-methyl-3-(p-isopropylphenyl)-propanal, 3-(p-tert-.butylphenyl)-propanal, tricyclodecenyl acetate, tricyclodecenyl propionate, 4-(4-hydroxy-4-methylpentyl)-3-cyclohexene carbaldehyde, 4-(4-methyl-3-pentenyl)-3-cyclohexene carbaldehyde, 4-acetoxy-3-pentyletetrahydropyran, methyl-dihydrojasmonate, 2-n-heptylcyclopentanone, 3-methyl-2-pentylcyclopentanone, n-decanal, 9-decenol-1, pehoxyethyl isobutyrate, phenylacetaldehyde dimethyl acetal, phenylacetaldehyde diethyl acetal, geranonitrile, citronellonitrile, cedryl acetate, 3-iso camphycyclohexanol, cedryl methyl ether, isolongifolanone, aubepine nitrile, aubepine, heliotropine, coumarin, eugenol, vanillin, diphenyl oxide, hydroxycitronellal, ionones, methylionones, isomethylioniones, irones, cis-3-hexenol and esters thereof, indane musk fragrances, tetralin musk fragrances, isochroman musk fragrances, macrocyclic ketones, macrolactone musk fragrances, ethylene brassylate, aromatic nitro-musk fragrances.

Exemplary fragrant molecules include bergamot oil, coriander oil, dimethyl heptanol, dimethyl benzyl carbinyl acetate, geranyl acetate, citronellyl acetate, rose synthetic, geranium bourbon, hedione, iso eugenol, methyl eugenol styrallyl acetate, stemone, rose oxide laevo, aldehyde C-11 undecyclic, derivatives of 2,6-dimethyl-2-alkoxy octan-7-ol, vertivert oil, vetiverol, vetiveryl, acetate, quaiac wood oil, esters ol-anthranilic acid, benzyl salicylate, benzyl benzoate, oak moss, eugenol, p-tert-butyl cyclohexyl acetate and coumarin.

The fragrance composition can be present in amounts of about 0.1 wt % to about 10 wt %, specifically about 0.5 to about 8 wt %, and more specifically about 1 to about 5 wt %, based on the total weight of the fabric softener composition. An exemplary amount of the fragrance composition is about 2 wt %, based on the total weight of the fabric softener composition.

The fabric softener composition may optionally contain other solvents to compatibilize the various ingredients of the composition. Exemplary solvents are diols, glycol ethers, or the like, though other solvents such as alcohols or ketones may be used in small quantities if desired.

The amount of water used in the present compositions will also vary over a fairly wide range. Normally, however, aqueous compositions will include at least about 40% by weight of water but not more than about 90% thereof, based on the total weight of the solvents. The amount of water may be adjusted to optimize the viscosity of the formulation provided the desired ratio of the ketal adduct to active compound is maintained. In some cases, the water content might be low, for example in solid compositions or non-aqueous concentrates. In these cases, the water can be as low as zero and as high as 30%.

The fabric softener composition can optionally comprise a thickening agent. The thickening agent is generally a polymer that is soluble in the ketal adduct and/or in the cosolvent used with ketal adduct. In one embodiment, the polymer is water-soluble. In another embodiment, the polymer is not water-soluble. The thickening agent can also serve as a viscosity modifier.

Examples of polymers that are water-soluble are polyvinyl alcohol, polyvinyl acetate, polyamides, hydroxyalkyl celluloses such as hydroxyethylcellulose and hydroxypropylcellulose, polyacrylic acid, or the like, or a combination comprising at least one of the foregoing water-soluble polymers.

Examples of polymers that are not water-soluble are polymethylmethacrylates, polyacrylates, polyesters, polyimides, polyethers, polyolefins, polyetherketones, polyether ether ketones, polyether ketone ketones, polycarbonates, polyarylene ethers, epoxies, polysulfones, polyethersulfones, polyetherimides, polynorbornylene, polysiloxanes, polyvinylchlorides, fluoropolymers, liquid crystalline polymers, ionomers, or the like, or combinations comprising at least one of the foregoing non-water-soluble polymers.

The polymer is preferably an oligomer that has a molecular weight of less than or equal to about 10,000 grams per mole, specifically less than or equal to about 5,000 grams per mole, and more specifically less than or equal to about 3,000 grams per mole. The polymer is present in an amount of about 0.01 wt % to about 20.0 wt %, specifically about 0.1 wt % to about 5 wt % based on the total weight of the fabric softener composition.

Inorganic viscosity control agents such as water-soluble, ionizable salts can also optionally be incorporated into the fabric softener compositions. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Salts used to control the composition viscosity are present in amounts of about 20 to about 10,000 parts per million (ppm), specifically amounts of about 20 to about 4,000 ppm, by weight of the fabric softener composition.

The fabric softener composition may also contain 0% to about 10%, specifically about 0.1% to about 5%, more specifically about 0.1% to about 2%, of a soil release agent. It is desirable for the soil release agent to be a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, their presence in such liquid compositions, even at levels which do not provide soil release benefits, is desirable.

In one embodiment, an exemplary soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of about 25:75 to about 35:65, said polyethylene oxide terephthalate containing polyethylene oxide blocks having molecular weights of about 300 to about 2000. The number molecular weight of this polymeric soil release agent is about 5,000 to about 55,000 grams per mole.

Another desirable polymeric soil release agent is a crystallizable polyester with repeat units of ethylene terephthalate units that comprise about 10% to about 15% by weight of ethylene terephthalate units together with about 10% to about 50% by weight of polyoxyethylene terephthalate units, derived from a polyoxyethylene glycol of number average molecular weight of from about 300 to about 6,000, and the molar ratio of ethylene terephthalate units to polyoxyethylene terephthalate units in the crystallizable polymeric compound is between 2:1 and 6:1. Examples of this polymer include the commercially available materials ZELCON® 4780 (from DuPont) and MILEASE® T (from ICI).

Other additives may also be added to the fabric softener composition. These additives are optional. Suitable additives are antioxidants, antiozonants, antibacterial agents, humectants, colorants, dyes, pigments, flavorings, food additives, pheromones, musks, a carbonate ion source, an alkalizing agent, a pH buffer, a conditioning agent, a chelant, an auxiliary agent, or the like, or a combination comprising at least one of the foregoing additives.

In one embodiment, in one method of manufacturing the fabric softener composition, a fabric softener active compound, a ketal adduct as described above, the fragrance composition, water, an optional solvent, an optional surfactant, an optional thickening agent, an optional compatibilizer and desired additives are blended together in the desired quantities in a reactor. The reactor may be a batch or continuous reactor. It is desirable for the reactor to be fitted with a mechanism for agitating the fabric softener composition. The fabric softener composition may be heated if desired to evaporate some solvent or to further compatibilization between the active compound, the ketal adduct and the optional solvent. Other methods of processing fabric softeners are detailed in U.S. Pat. No. 5,545,350 to Baker et al. the entire contents of which are incorporated herein by reference. The fabric softener may be formulated as a solid, a liquid concentrate, a diluted composition from liquid concentrate, or as a liquid concentrate formulated from a solid.

The following non-limiting examples are meant to demonstrate fabric softener compositions, methods of manufacture thereof and articles comprising the same.

EXAMPLES

Example 1

These examples show that the use of a ketal converts an aqueous fabric softener composition into a pourable formulation under common manufacturing conditions. The formulations with the ketal require less heat and less energy to process and mix the formulations. The ketals used in the fabric softener compositions in this particular example are the glycerol ketal of ethyl levulinate (Et-LGK). These fabric softener compositions are shown in the Table 1.

In order to manufacture the fabric softener compositions of the Table 1, a surfactant, a ketal, and water were weighed into vials in the amounts shown in the Table 1. The vials were capped and placed in a water bath at 35° C. and mixed with a magnetic stir bar for 5 to 10 minutes. The temperature of the water bath was increased and observations were made 5 to 10 minutes after the temperature stabilized as indicated in the Table 1.

The cationic surfactants (alternatively sometimes referred to as fabric softeners) are listed in the Table 1 are detailed as follows. AROSURF TA 101 (distearyl dimethyl ammonium chloride quaternary, 98% solids from Evonik) is described as dispersible fabric softener for rinse cycle softening in commercial laundries where cooler rinse water is needed. REWOQUAT WE 28 US (Di-Nortallow Carboxyethyl) Hydroxyethyl Methylammonium Methosulfate (INCI: Dihydrogenated Tallowethyl Hydroxyethylmonium Methosulfate), 90% solids in isopropylic alcohol from Evonik) is described as a vegetable-based ester quat for biodegradable fabric softener dispersions. ADOGEN 442 (di-hydrogenated tallow dimethyl ammonium chloride (INCI: quaternium-18), 75% active in isopropylic alcohol from Evonik) is described as a traditional quat for fabric softeners with premium softness and good anti-static properties for use in rinse formulations in both commercial and domestic laundry applications. Use levels as low as 0.05% based on weight of fabric can provide excellent softening.

TABLE 1

| Example | Surfactant | Wt % Surfactant | Wt % LGK | Wt % Water | Wt % isopropanol | Visual @ 35° C. | Visual @ 40° C. | Visual @ 60° C. |
|---|---|---|---|---|---|---|---|---|
| Example 1A | AROSURF TA 101 | 25 | 25 | 50 | 0 | Clear, pourable liquid | Clear, pourable liquid | Clear, pourable liquid |
| Example 1B | AROSURF TA 101 | 25 | 0 | 75 | 0 | White paste, does not pour | White paste, does not pour | White paste, does not pour |
| Example 1C | AROSURF TA 101 | 25 | 0 | 50 | 25 | Cloudy, pourable liquid | Clear, pourable liquid | Clear, pourable liquid |
| Example 2A | ADOGEN 442 | 25 | 25 | 50 | 0 | Cloudy, pourable liquid | Clear, pourable liquid | Clear, pourable liquid |
| Example 2B | ADOGEN 442 | 25 | 0 | 75 | 0 | Opaque gel, does not pour | Opaque gel, does not pour | Opaque gel, does not pour |
| Example 3A | REWOQUAT WE 28 US | 25 | 25 | 50 | 0 | Cloudy, pourable liquid | Cloudy, pourable liquid | Clear, pourable liquid |
| Example 3B | REWOQUAT WE 28 US | 25 | 0 | 75 | 0 | White chunky gel, does not pour | White chunky gel, does not pour | White chunky gel, does not pour |

From the Table 1 above, it may be seen that the composition with glycerol ketal of levulinic acid (Et-LGK) turned into a clear liquid at a lower temperature than the composition with isopropanol (1A vs. 1C).

Example 2

These examples demonstrate the use of the propylene glycol ketal of ethyl levulinate (LPK) as a compatibilizing solvent in the fabric softener compositions. The fabric softener compositions are shown in the Table 2 below. In order to manufacture the fabric softener compositions of the Table 2, a surfactant, a ketal, and water were weighed into vials in the amounts shown in the Table 1. The vials were capped and placed in a water bath at 35° C. and mixed with a magnetic stir bar for 5 to 10 minutes. The temperature of the water bath was increased and observations were made 5 to 10 minutes after the temperature stabilized as indicated in the Table 1. The surfactants used in the Table 2 are the same as those used in the Table 1.

TABLE 2

| Example | Surfactant | Wt. % Surfactant | Wt. % LPK | Wt. % Water | Visual @ 35° C. | Visual @ 45° C. | Visual @ 60° C. |
|---|---|---|---|---|---|---|---|
| Example 4A | AROSURF TA 101 | 25 | 25 | 50 | white, high-viscosity liquid, pourable | white, high-viscosity liquid, pourable | white, high-viscosity liquid, pourable |
| Example 4B | AROSURF TA 101 | 25 | 0 | 75 | White paste, does not pour | White paste, does not pour | White paste, does not pour |
| Example 5A | ADOGEN 442 | 25 | 25 | 50 | White chunky gel, does not pour | White chunky gel, does not pour | White chunky gel, does not pour |
| Example 5B | ADOGEN 442 | 25 | 0 | 75 | Opaque gel, does not pour | Opaque gel, does not pour | Opaque gel, does not pour |
| Example 6A | REWOQUAT WE 28 US | 25 | 25 | 50 | Opaque slurry, difficult to pour | Clear, pourable liquid | Clear, pourable liquid |
| Example 6B | REWOQUAT WE 28 US | 25 | 0 | 75 | White chunky gel, does not pour | White chunky gel, does not pour | White chunky gel, does not pour |

The results for the compositions in the Table 2 show a variety of different compositions can be made, including solid compositions, gel-like compositions, and clear pourable liquids (example 6A). The solid fabric softener compositions can be ground into powders for ease of transportation.

Example 3

This example was conducted to demonstrate the manufacturing of fabric softener liquid concentrates that are pourable. For these examples, ethanol was used as a cosolvent. In order to manufacture the fabric softener compositions of the Table 3, a surfactant, a ketal, ethanol and water were weighed into vials in the amounts shown in the Table 1. The ketals used were either LGK or LPK. The vials were capped and placed in a water bath at 65° C. and mixed with a magnetic stir bar for 5 to 10 minutes. The mixtures were removed from the water bath and allowed to cool to room temperature on a bench-top. Observations about visual appearance at room temperature were recorded within 1 hour of cooling.

TABLE 3

| Example | Surfactant | Wt. Surfactant (g) | Wt. LGK (g) | Wt. LPK (g) | Wt. Water (g) | Wt. ethanol (g) | Visual @ 25° C. | Visual @ 65° C. |
|---|---|---|---|---|---|---|---|---|
| Example 7A | REWOQUAT WE 28 US | 2.5 | 1.25 | 0 | 5 | 1.25 | Low viscosity, white liquid with fine swollen particles | Cloudy |
| Example 7B | REWOQUAT WE 28 US | 2.5 | 0 | 1.25 | 5 | 1.25 | Low viscosity, white liquid with fine swollen particles | Clear |
| Example 7C | AROSURF TA 101 | 2.5 | 2.5 | 2.5 | 0 | 2.5 | Clear, low viscosity fluid | Clear |

The resulting compositions were either cloudy (see Example 7A) or clear (Examples 7B and 7C).

Example 4

The following example demonstrates liquid compositions with a pearlescent effect, which was obtained by adding 15% aqueous calcium chloride solution to example 7A in Table 3 at room temperature to reach the calcium chloride content given in the Table 4 below. (See Examples 8A and 8B.) The contents were mixed at room temperature with a magnetic stir bar and then the vial was placed back in the water bath at 65° C. for approximately 5 minutes with stirring. The sample was placed on the bench-top and allowed to cool to room temperature without stirring.

TABLE 4

| Example | Surfactant | Wt. Surfactant (g) | Wt. LGK (g) | Wt. LPK (g) | Wt. Water (g)* | Wt. ethanol (g) | Wt. of $CaCl_2$ (g) | Visual @ 25° C. | Visual @ 65° C. |
|---|---|---|---|---|---|---|---|---|---|
| Example (8A) | REWOQUAT WE 28 US | 2.5 | 1.25 | 0 | 5 | 1.25 | 0.075 | Opaque pearlescent liquid | Clear |
| Example (8B) | REWOQUAT WE 28 US | 2.5 | 0 | 1.25 | 5 | 1.25 | 0.075 | Opaque pearlescent liquid | Cloudy |

*This column does not include the water that was added with the aqueous calcium chloride.

Example 5

This example demonstrates the use of isopropanol as a co-solvent. The surfactant, ketal, isopropanol, and water (if present) were weighed into vials. The vials were capped and placed in a water bath at 65° C. and mixed with a magnetic stir bar for 5 to 10 minutes. The mixtures were removed from the water bath and allowed to cool to room temperature on the bench-top. Observations about visual appearance at room temperature were recorded within 1 hour of cooling. The compositions are shown in the Table 5 below.

TABLE 5

| Example | Surfactant | Wt. Surfactant (g) | Wt. LGK (g) | Wt. LPK (g) | Wt. Water (g) | Wt. isopropanol (g) | Visual @ 25° C. | Visual @ 65° C. |
|---|---|---|---|---|---|---|---|---|
| Example (9A) | REWOQUAT WE 28 US | 2.5 | 1.25 | 0 | 5 | 1.25 | Pourable, low viscosity, white liquid with fine swollen particles | Clear |
| Example (9B) | REWOQUAT WE 28 US | 2.5 | 0 | 1.25 | 5 | 1.25 | Pourable, low viscosity, white liquid with fine swollen particles | Clear |
| Example (9C) | AROSURF TA 101 | 2.5 | 3 | 3 | 0 | 1.5 | Low viscosity slurry with fine particles | Clear |

From the Examples (9A, 9B and 9C) above, it may be seen that a pourable low viscosity fabric softener compositions can be made using ketals as compatibilizers.

Example 6

This example demonstrates compositions having the consistency of a lotion. The following example demonstrates liquid compositions with ketal, alcohol (isopropanol or ethanol), and salt. Aqueous calcium chloride solution (15%) was added to examples of Table 5 (Examples 9A and 9B) at room temperature to reach 0.075 g of calcium chloride. The contents were mixed at room temperature with a magnetic stir bar and then the vials were placed back in the water bath at 65° C. for approximately 5 minutes with stirring. The samples were placed on the bench-top and allowed to cool to room temperature without stirring for 1 hour. The compositions are shown in the Table 6.

TABLE 6

| Example | Surfactant | Wt. Surfactant (g) | Wt. Et-LGK (g) | Wt. Et-LPK (g) | Wt. alcohol (g) | Wt. of $CaCl_2$ (g) | Visual @ 25 C. | Visual @ 65 C. |
|---|---|---|---|---|---|---|---|---|
| Example (10A) | AROSURF TA 101 | 2.5 | 3 | 3 | 1.5 (isopropanol) | 0 | Low viscosity slurry with fine particles | Clear |
| Example (10B) | AROSURF TA 101 | 2.5 | 3 | 3 | 1.5 (isopropanol) | 0.09 | Lotion-like consistency | Clear |
| Example (10C) | AROSURF TA 101 | 2.5 | 2.5 | 2.5 | 2.5 (ethanol) | 0.075 | Lotion-like consistency | Clear |
| Example (10D) | AROSURF TA 101 | 2.5 | 3.75 | 3.75 | 0 | 0.075 | Lotion-like consistency | Clear |

Concentrates with a lotion-like consistency were obtained. Example 10A shows that a concentrate of AROSURF TA101 formed a low viscosity slurry. The addition of calcium chloride in the composition (Example 10B) caused the composition to form a lotion-like consistency. A lotion-like consistency can also be obtained when ethanol was used as a co-solvent (Example 10C). A composition without alcohol (Example 10D) also forms a lotion-like consistency. After 2 weeks, the compositions of Examples 10B and 10C had undergone phase separation, whereas Example 10D retained its appearance and remained a lotion.

Example 7

This example was conducted to demonstrate solid fabric softener compositions. These compositions are shown in the Table 7 below.

A surfactant, ketal, and alcohol (if present) are weighed into vials. The vials were capped and placed in a water bath at 65° C. and mixed with a magnetic stir bar for 5 to 10 minutes. The mixtures were removed from the water bath and allowed to cool to room temperature on the bench-top. 15% aqueous calcium chloride solution was added to the vials at room temperature to reach the weight of calcium chloride as indicated in Table 6. The contents were mixed at room temperature with a magnetic stir bar and then the vials were placed back in the water bath at 65° C. for approximately 5 minutes with stirring. The mixtures were removed from the water bath and allowed to cool to room temperature on the bench-top. Observations about visual appearance at room temperature were recorded within 1 hour of cooling. The quality of the solid compositions is detailed in the Table 7 below.

TABLE 7

| Example | Surfactant | Wt. Surfactant (g) | Wt. Et-LGK (g) | Wt. Et-LPK (g) | Wt. isopropanol (g) | Wt. water (g)* | Wt. of $CaCl_2$ (g) | Visual @ 25° C. | Visual @ 65° C. |
|---|---|---|---|---|---|---|---|---|---|
| Example (11A) | AROSURF TA 101 | 2.5 | 2.5 | 0 | 0 | 5 | 0.0825 | Malleable solid | Clear |
| Example (11B) | AROSURF TA 101 | 2.5 | 0 | 2.5 | 0 | 5 | 0.09 | Malleable solid | Clear |
| Example (11C) | AROSURF TA 101 | 2.5 | 2.5 | 2.5 | 2.5 | 0 | 0 | Low viscosity slurry with fine particles | Clear |
| Example (11D) | AROSURF TA 101 | 2.5 | 2.5 | 2.5 | 2.5 | 0 | 0.075 | Solid | Clear |
| Example (11E) | ADOGEN 442 | 2.5 | 2.5 | 0 | 0 | 5 | .0825 | Malleable solid | Clear |

*This column does not include the water that was added with the aqueous calcium chloride.

Example 8

This example was conducted to demonstrate pourable (e.g., flowable) fabric softener compositions. The compositions along with their properties are detailed in Table 8. Pourable compositions are manufactured by adding a salt that reduces the viscosity of the composition.

Surfactant, ketal, alcohol (if present), and water (if present) were weighed into vials. The vials were capped and placed in a water bath at 65° C. and mixed with a magnetic stir bar for 5 to 10 minutes. The mixtures were removed from the water bath and allowed to cool to room temperature on the bench-top. Salt, when present, was added as a 15 wt % aqueous calcium chloride solution at reach temperature to reach the weight of calcium chloride as indicated in Table 7. The contents were mixed at room temperature with a magnetic stir bar and then the vials with salt were placed back in the water bath at 65° C. for approximately 5 minutes with stirring. The mixtures were removed from the water bath and allowed to cool to room temperature on the bench-top. Observations about visual appearance at room temperature were recorded within 1 hour of cooling.

TABLE 8

| Example | Surfactant | Wt. Surfactant (g) | Wt. Et-LGK (g) | Wt. Et-LPK (g) | Wt. isopropanol (g) | Wt. water (g)* | Wt. of $CaCl_2$ (g) | Visual @ 25° C. | Visual @ 65° C. |
|---|---|---|---|---|---|---|---|---|---|
| Example (12A) | REWOQUAT WE 28 US | 2.5 | 0 | 2.5 | 0 | 5 | 0 | High-viscosity gel/solid | High-viscosity gel/solid |
| Example (12B) | REWOQUAT WE 28 US | 2.5 | 0 | 2.5 | 0 | 5 | 0.075 | Pourable, cloudy mixture | Clear |

*This column does not include the water that was added with the aqueous calcium chloride.

Example 12B forms a clear fabric softener composition at temperatures of about 65° C.

Example 9

This example was conducted to demonstrate compositions for non-aqueous fabric softener concentrates. This example also demonstrates methods of manufacturing these concentrates.

Surfactant and ketal were weighed into vials. The vials were capped and placed in a water bath at 65° C. and mixed with a magnetic stir bar until the solutions were clear, about 5 to 10 minutes. The mixtures were removed from the water bath and allowed to cool to room temperature on the bench-top. Observations about visual appearance at room temperature were recorded within 1 hour of cooling.

The following examples show compositions of non-aqueous concentrates in a variety of forms (including pourable compositions and solids at room temperature). All formulations formed clear solutions at 65° C., which indicates that they can be processed easily. The compositions are shown in the Table 9.

TABLE 9

| Example | Surfactant | Wt. % surfactant | Wt. % Et-LGK | Wt. % ET-LPK | Visual appearance at 25° C. | Visual appearance at 65° C. |
|---|---|---|---|---|---|---|
| Example (13A) | AROSURF-TA-101 | 25 | 75 | 0 | Easily pourable, cloudy gel | Clear pourable solution |
| Example (13B) | AROSURF-TA-101 | 50 | 50 | 0 | Homogeneous white solid | Clear pourable solution |
| Example (13C) | AROSURF-TA-101 | 75 | 25 | 0 | Homogeneous white solid | Clear pourable solution |
| Example (13D) | AROSURF-TA-101 | 25 | 0 | 75 | Homogeneous white solid | Clear pourable solution |
| Example (13E) | AROSURF-TA-101 | 50 | 0 | 50 | Homogeneous white solid | Clear pourable solution |
| Example (13F) | REWOQUAT WE 28 US | 25 | 0 | 75 | White, pourable, fine slurry | Clear pourable solution |
| Example (13G) | REWOQUAT WE 28 US | 50 | 0 | 50 | Uniformly cloudy, high-viscosity gel | Clear pourable solution |

From the Table 9, it may be seen that at 25° C., some of the fabric softener compositions are homogenous solids, while at 65° C., some of the compositions are clear pourable solutions.

Example 10

This example was conducted to determine the viability of fabric softener compositions after they are subjected to freeze thaw cycles. The respective compositions along with their properties are shown in the Tables 10 and 11.

Sample vials with the respective compositions were placed in a freezer at 0° C. for at least 1 hour and no more than 15 hours. Samples were removed from the freezer and placed on the bench-top to warm to room temperature (73° F.) under ambient conditions. Observations about visual appearance at room temperature were recorded after a minimum of two hours. Observations were made after each freeze/thaw cycle. A sample was considered to have failed when its visual appearance at room temperature after thawing substantially differed from its original appearance at room temperature. These examples show that the freeze/thaw stability is improved in aqueous fabric softener compositions containing levulinic ketals. Table 10 displays the compositions.

TABLE 10

| Example | Surfactant | Wt. % surfactant | Wt. % Et-LGK | Wt. % Et-LPK | Wt. % Water | Failure after Freeze/Thaw Cycle # |
|---|---|---|---|---|---|---|
| Example 14A | AROSURF TA 101 | 5 | 0 | 0 | 95 | 1 |
| Example 14B | AROSURF TA 101 | 5 | 5 | 0 | 90 | >4 |
| Example 14C | AROSURF TA 101 | 5 | 0 | 5 | 90 | >4 |
| Example 14D | AROSURF TA 101 | 5 | 10 | | 85 | >4 |
| Example 14E | AROSURF TA 101 | 5 | 15 | | 80 | 2 |
| Example 14F | AROSURF TA 101 | 5 | 95 | 0 | 0 | >4 |

Table 11 shows aqueous fabric softener concentrate compositions that survived at least 4 cycles of freeze/thaw with no change in visual appearance.

TABLE 11

| Example | Surfactant | Wt. Surfactant (g) | Wt. Et-LGK (g) | Wt. Et-LPK (g) | Wt. isopropanol (g) | Wt. ethanol (g) | Wt. water (g)* | Wt. of 15% aqueous $CaCl_2$ (g) |
|---|---|---|---|---|---|---|---|---|
| Example 15A | REWOQUAT WE 28 US | 2.5 | 1.25 | 1.25 | 1.25 | 0 | 5 | 0.5 |
| Example 15B | REWOQUAT WE 28 US | 2.5 | 1.25 | 0 | 1.25 | 0 | 5 | 0.5 |
| Example 15C | REWOQUAT WE 28 US | 2.5 | 0 | 1.25 | 0 | 1.25 | 5 | 0.5 |

*This column does not include the water that was added with the aqueous calcium chloride.

While the invention has been described with reference to some embodiments, it will be understood by those skilled in the art that various changes may be made and equivalents may be substituted for elements thereof without departing from the scope of the invention. In addition, many modifications may be made to adapt a particular situation or material to the teachings of the invention without departing from essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A fabric softener composition comprising:

a fabric softener active compound that comprises a quaternary ammonium salt and/or an imidazolinium salt, and a ketal adduct of formula (12)

(12)

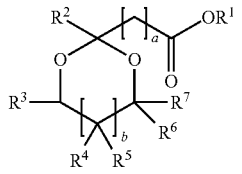

wherein $R^1$ is $C_{1-6}$ alkyl, $R^2$ is hydrogen or $C_{1-3}$ alkyl, each $R^3$ and $R^4$, is independently hydrogen or $C_{1-6}$ alkyl, each $R^5$ and $R^6$ is independently hydrogen or $C_{1-6}$ alkyl, or hydroxymethyl, $R^7$ is hydrogen, $C_{1-6}$ alkyl, $C_{1-6}$ alkyl substituted with up to four $OR^8$ groups wherein $R^8$ is hydrogen, $C_{1-6}$ alkyl, or acetyl, a is 2-3, and b is 0-1.

2. The fabric softener composition of claim 1, wherein $R^1$ is $C_{1-6}$ alkyl, $R^2$ is methyl, each $R^3$ and $R^4$, is independently hydrogen or $C_{1-3}$ alkyl, each $R^5$ and $R^6$ is independently hydrogen, $C_{1-3}$ alkyl, or hydroxymethyl, $R^7$ is hydrogen, $C_{1-3}$ alkyl, or $C_{1-4}$ alkyl substituted with up to four —$OR^8$ groups wherein $R^8$ is hydrogen or a $C_{1-3}$ alkyl group, a is 2-3, and b is 0-1.

3. The fabric softener composition of claim 1, wherein $R^1$ is $C_{1-4}$ alkyl, $R^2$ is methyl, $R^3$ is hydrogen, $R^6$ is hydrogen, $C_{1-3}$ alkyl, or hydroxymethyl, $R^7$ is hydrogen, $C_{1-3}$ alkyl, or $C_{1-4}$ alkyl substituted with up to four —$OR^8$ groups wherein $R^8$ is hydrogen or a $C_{1-3}$ alkyl group, a is 2-3, and b is 0.

4. The fabric softener composition of claim 1, wherein $R^1$ is $C_{1-4}$ alkyl or acetyl, $R^2$ is methyl, $R^3$ is hydrogen, $R^6$ is hydrogen, methyl, ethyl, or —$CH_2OH$, $R^7$ is methyl, ethyl, —$CH_2OH$, —$CH_2OCH_3$, —$CH_2OCH_2CH_3$, —$CH(OH)CH_2OH$, or —$(CH(OH))_3CH_2OH$, a is 2, and b is 0.

5. The fabric softener composition of claim 1, wherein the ketal adduct is of formula (12a):

(12a)

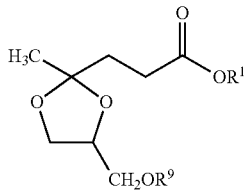

wherein $R^1$ is a $C_{1-4}$ alkyl, and $R^9$ is hydrogen or $C_{1-4}$ alkyl.

6. The fabric softener composition of claim 1, wherein the ketal adduct is of formula (12b)

(12b)

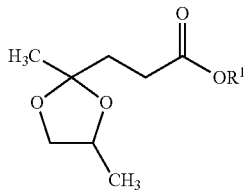

wherein $R^1$ is a $C_{1-4}$ alkyl.

7. The fabric softener composition of claim 1, further comprising a fragrant molecule; the fragrant molecule being derived directly or indirectly from animals, plants, fruit, flowers, or a combination thereof.

8. The fabric softener composition of claim 7, where the fragrant molecule is derived from berries, allspice, juniper, seeds, almond, anise, celery, cumin, nutmeg oil, bark, cassia, cinnamon, sassafras, wood, camphor, cedar, rosewood, sandalwood, agar wood, rhizome, galangal, ginger, leaves, basil, bay leaf, cinnamon, common sage, eucalyptus, lemon grass, melaleuca, oregano, patchouli, peppermint, pine, rosemary, spearmint, tea tree, thyme, wintergreen, resin, frankincense, myrrh, flowers, cannabis, chamomile, clary sage, clove, scented geranium, hops, hyssop, jasmine, lavender, manuka, marjoram, rose, rosemary, basil, lemon grass, ylang-ylang, peel, bergamot, grapefruit, lemon, lime, orange, tangerine, root, valerian, mango, or a combination comprising at least one of the foregoing.

9. The fabric softener composition of claim 7, where the fragrant molecule is derived from alcohols; aldehydes; esters; ketones; lactones; thiols; linear terpenes; cyclic terpenes; aromatic species; amines, or a combination thereof.

10. The fabric softener composition of claim 9, where the alcohols are furaneol, 1-hexanol, cis-3-hexen-1-ol, menthol, or a combination comprising at least one of the foregoing alcohols; where the aldehydes are acetaldehyde, hexanal, cis-3-hexenal, furfural, or a combination comprising at least one of the foregoing aldehydes; where the esters are fructone, hexyl acetate, ethyl methylphenylglycidate, methyl formate, methyl acetate, methyl butyrate, methyl butanoate, ethyl acetate, ethyl butyrate, ethyl butanoate, isoamyl acetate, pentyl butyrate, pentyl butanoate, pentyl pentanoate, or a combination comprising at least one of the foregoing esters; where the ketones are dihydrojasmone, oct-1-en-3-one, 2-acetyl-1-pyrroline, 6-acetyl-2,3,4,5-tetrahydropyridine, or a combination comprising at least one of the foregoing ketones; where the lactones are γ-decalactone, γ-nonalactone, δ-octalactone, or a combination comprising at least one of the foregoing lactones; where the thiols are ethanethiol, grapefruit mercaptan, methanethiol, 2-methyl-2-propanethiol or a combination comprising at least one of the foregoing lactones; where the linear terpenes are myrcene, geraniol, nerol, citral, lemonal, geranial, neral, citronellal, citronellol, linalool, nerolidol, or a combination comprising at least one of the foregoing linear terpenes; where the cyclic terpenes are limonene, camphor, terpincol, ionone, thujuon, or a combination comprising at least one of the foregoing cyclic terpenes; where the aromatic species are benzaldehyde, eugenol, cinnamaldehyde, ethyl maltol, vanillin, anisole, anethole, estragole, thymol, or a combination comprising at least one of the foregoing aromatic species; where the amines are thiethylamine, trimethylamine, cadaverine, pyridine, indole, skatole, or a combination comprising at least one of the foregoing amines; or a combination comprising at least one of the foregoing amines.

11. The fabric softener composition of claim 1, further comprising a surfactant.

12. The fabric softener composition of any one of claim 1 through 11, further comprising an additive selected from a solvent, a thickening agent, a soil release agent, an antioxidant, an antiozonant, an antibacterial agent, a humectant, a colorant, a dye, a pigment, a flavoring, a food additive, a pheromone, a musk, a carbonate ion source, an alkalizing agent, a pH buffer, a conditioning agent, a chelant, an auxiliary agent, or a combination comprising at least one of the foregoing additives.

13. The fabric softener composition of claim 1, where the quarternary ammonium salt is of formula (1)

$$[(R)_{4-m}—N^{(+)}—[(CH_2)_n—Y—R^1]_m]X^{(-)} \quad (1)$$

wherein each R substituent is hydrogen or a short chain $C_1$-$C_6$, each m is 2 or 3; each n is from 1 to about 4; each Y is —O—(O)C—, —(R)N—(O)C—, —C(O)—N(R)—, or —C(O)—O—; the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

14. The fabric softener composition of claim 1, where the quarternary ammonium salt is of formula (2)

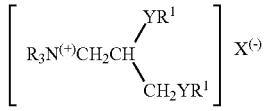

(2)

wherein each R substituent is hydrogen or a short chain $C_1$-$C_6$, each Y is —O—(O)C—, —(R)N—(O)C—, —C(O)—N(R)—, or —C(O)—O—; the sum of carbons in each $R^1$ is $C_6$-$C_{22}$ and where $X^{(-)}$ is a softener-compatible anion, selected from the group consisting of chloride, bromide, methylsulfate, ethylsulfate, sulfate, and/or nitrate.

15. An article comprising the composition of claim 1.

16. The article of claim 15, being in the form of a solid, a molded solid, a powdered solid, a liquid aqueous concentrate, a liquid non-aqueous concentrate, a lotion, or a dilute liquid.

17. The article of claim 15, wherein the composition is disposed on or embedded in a woven material.

18. A fabric softener composition comprising:

about 2 wt % to about 90 wt % of a fabric softener active compound that comprises a quarternary ammonium salt and/or an imidazolinium salt, based on the total weight of the fabric softening composition;

about 2 wt % to about 95 wt %, based on the weight of the composition, of a ketal adduct of formula (12a)

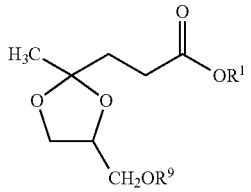

(12a)

wherein $R^1$ is a $C_{1-4}$ alkyl, and $R^9$ is hydrogen or $C_{1-4}$ alkyl; and at least one additive selected from a fragrant compound, a solvent, a surfactant, a thickening agent, a soil release agent, an antioxidant, an antiozonant, an antibacterial agent, a humectant, a colorant, a dye, a pigment, a flavoring, a food additive, a pheromone, a musk, a carbonate ion source, an alkalizing agent, a pH buffer, a conditioning agent, a chelant, an auxiliary agent, or a combination comprising at least one of the foregoing additives.

19. The fabric softener composition of claim 18, where $R^1$ is ethyl or butyl and $R^9$ is hydrogen.

20. The fabric softener composition of claim 18, wherein the quarternary ammonium salt is of formula (1):

$$[(R)_{4-m}—N^{(+)}—[(CH_2)_n—Y—R^1]_m]X^{(-)} \quad (1)$$

wherein each R substituent is hydrogen or a short chain $C_1$-$C_6$, each m is 2 or 3; each n is from 1 to about 4; each Y is —O—(O)C—, —(R)N—(O)C—, —C(O)—N(R)—, or —C(O)—O—; the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

21. The fabric softener composition of claim 18, wherein the quarternary ammonium salt is of formula (2):

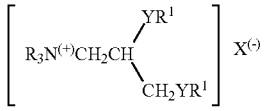

(2)

wherein each R substituent is hydrogen or a short chain $C_1$-$C_6$, each Y is —O—(O)C—, —(R)N—(O)C—, —C(O)—N(R)—, or —C(O)—O—, the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

22. The fabric softener composition of claim 18, wherein the composition is in the form of a liquid aqueous concentrate, a liquid non-aqueous concentrate, or a dilute liquid.

23. The fabric softener composition of claim 18, wherein the composition is disposed on or embedded in a woven article.

24. A fabric softener composition comprising:

about 2 wt % to about 90 wt % of a fabric softener active compound that comprises a quarternary ammonium salt and/or an imidazolinium salt, based on the total weight of the fabric softening composition;

about 2 wt % to about 95 wt %, based on the weight of the composition, of a ketal adduct of formula (12b)

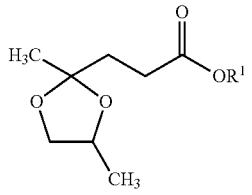

(12b)

wherein $R^1$ is a $C_{1-4}$ alkyl; and an additive selected from a fragrant compound, a solvent, a thickening agent, a surfactant, a soil release agent, an antioxidant, an antiozonant, an antibacterial agent, a humectant, a colorant, a dye, a pigment, a pheromone, a musk, a carbonate ion source, an alkalizing agent, a pH buffer, a conditioning agent, a chelant, an auxiliary agent, or a combination comprising at least one of the foregoing additives.

25. The fabric softener composition of claim 24, where $R^1$ is ethyl or butyl.

26. The fabric softener composition of claim 24, wherein the quarternary ammonium salt is of formula (1):

$$[(R)_{4-m}—N^{(+)}—[(CH_2)_n—Y—R^1]_m]X^{(-)} \quad (1)$$

wherein each R substituent is hydrogen or a short chain $C_1$-$C_6$, each m is 2 or 3; each n is from 1 to about 4; each Y is —O—(O)C—, —(R)N—(O)C—, —C(O)—N(R)—, or —C(O)—O—; the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

27. The fabric softener composition of claim 24, wherein the quarternary ammonium salt is of formula (2):

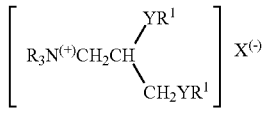

(2)

wherein each R substituent is hydrogen or a short chain $C_1$-$C_6$, each Y is —O—(O)C—, —(R)N—(O)C—, —C(O)—N(R)—, or —C(O)—O—, the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

28. The fabric softener composition of claim 24, wherein the composition is in the form of a liquid aqueous concentrate, a liquid non-aqueous concentrate, or a dilute liquid.

29. The fabric softener composition of claim 24, wherein the composition is disposed on or embedded in a woven article.

30. A method comprising:

blending a fabric softener active compound that comprises a quarternary ammonium salt and/or an imidazolinium salt and a ketal adduct of formula (12)

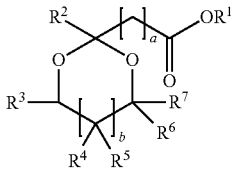

(12)

wherein $R^1$ is $C_{1-6}$ alkyl, $R^2$ is hydrogen or $C_{1-3}$ alkyl, each $R^3$ and $R^4$, is independently hydrogen or $C_{1-6}$ alkyl, each $R^5$ and $R^6$ is independently hydrogen or $C_{1-6}$ alkyl, or hydroxymethyl, $R^7$ is hydrogen, $C_{1-6}$ alkyl, $C_{1-6}$ alkyl substituted with up to four $OR^8$ groups wherein $R^8$ is hydrogen, $C_{1-6}$ alkyl, or acetyl, a is 2-3, and b is 0-1; where the fabric softener active compound is a quarternary ammonium salt and/or an imidazolinium salt.

31. The method of claim 30, wherein $R^1$ is $C_{1-6}$ alkyl, $R^2$ is methyl, each $R^3$ and $R^4$, is independently hydrogen or $C_{1-3}$ alkyl, each $R^5$ and $R^6$ is independently hydrogen, $C_{1-3}$ alkyl, or hydroxymethyl, $R^7$ is hydrogen, $C_{1-3}$ alkyl, or $C_{1-4}$ alkyl substituted with up to four —$OR^8$ groups wherein $R^8$ is hydrogen or a $C_{1-3}$ alkyl group, a is 2-3, and b is 0-1.

32. The method of claim 30, wherein $R^1$ is $C_{1-4}$ alkyl, $R^2$ is methyl, $R^3$ is hydrogen, $R^6$ is hydrogen, $C_{1-3}$ alkyl, or hydroxymethyl, $R^7$ is hydrogen, $C_{1-3}$ alkyl, or $C_{1-4}$ alkyl substituted with up to four —$OR^8$ groups wherein $R^8$ is hydrogen or a $C_{1-3}$ alkyl group, a is 2-3, and b is 0.

33. The method of claim 30, wherein $R^1$ is $C_{1-4}$ alkyl or acetyl, $R^2$ is methyl, $R^3$ is hydrogen, $R^6$ is hydrogen, methyl, ethyl, or —$CH_2OH$, $R^7$ is methyl, ethyl, —$CH_2OH$, —$CH_2OCH_3$, —$CH_2OCH_2CH_3$, —$CH(OH)CH_2OH$, or —$(CH(OH))_3CH_2OH$, a is 2, and b is 0.

34. The method of claim 30, wherein the ketal adduct is of formula (12a) or 12(b):

(12a)

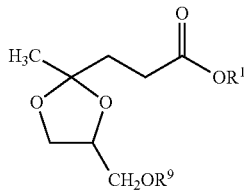

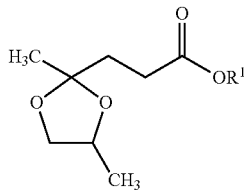

wherein $R^1$ is a $C_{1-4}$ alkyl, and $R^9$ is hydrogen or $C_{1-4}$ alkyl.

35. The method of claim 30, wherein the quarternary ammonium salt is of formula (1)

$$[(R)_{4-m}—N^{(+)}—[(CH_2)_n—Y—R^1]_m]X^{(-)} \quad (1)$$

wherein each R substituent is hydrogen or a short chain $C_1$-$C_6$, each m is 2 or 3; each n is from 1 to about 4; each Y is —O—(O)C—, —(R)N—(O)C—, —C(O)—N(R)—, or —C(O)—O—; the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

36. The method of claim 30, wherein the quarternary ammonium salt is of formula (2):

(2)

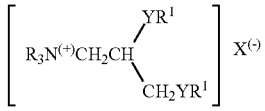

wherein each R substituent is hydrogen or a short chain $C_1$-$C_6$, each Y is —O—(O)C—, —(R)N—(O)C—, —C(O)—N(R)—, or —C(O)—O—; the sum of carbons in each $R^1$ is $C_6$-$C_{22}$ and where X— is a softener-compatible anion, selected from the group consisting of chloride, bromide, methylsulfate, ethylsulfate, sulfate, and/or nitrate.

* * * * *